US008472794B2

(12) United States Patent
Perry et al.

(10) Patent No.: US 8,472,794 B2
(45) Date of Patent: Jun. 25, 2013

(54) APPARATUS WITH EXPANSION CHAMBER PROVIDING LARGE HEAT DISTRIBUTION

(76) Inventors: Lori Perry, Rancho Palos Verdes, CA (US); Gustavo Vargas, Rancho Palos Verdes, CA (US)

( * ) Notice: Subject to any disclaimer, the term of this patent is extended or adjusted under 35 U.S.C. 154(b) by 651 days.

(21) Appl. No.: 12/688,576

(22) Filed: Jan. 15, 2010

(65) Prior Publication Data

US 2010/0183286 A1 Jul. 22, 2010

Related U.S. Application Data

(60) Provisional application No. 61/145,450, filed on Jan. 16, 2009.

(51) Int. Cl.
*F24H 1/20* (2006.01)

(52) U.S. Cl.
USPC ..... 392/455; 392/441; 392/451; 392/457; 392/497; 392/503

(58) Field of Classification Search
USPC ..... 392/441, 442–464
See application file for complete search history.

(56) References Cited

U.S. PATENT DOCUMENTS

| | | | | |
|---|---|---|---|---|
| 3,202,321 | A * | 8/1965 | Homeyer | 222/108 |
| 4,158,439 | A * | 6/1979 | Gibbs | 237/55 |
| 4,424,767 | A * | 1/1984 | Wicke et al. | 122/13.3 |
| 4,874,104 | A * | 10/1989 | Klammer et al. | 220/4.21 |
| 4,906,817 | A * | 3/1990 | Kurz | 392/442 |
| 5,331,996 | A * | 7/1994 | Ziehm | 137/14 |
| 5,668,922 | A * | 9/1997 | Ross et al. | 392/441 |
| 6,659,048 | B1 * | 12/2003 | DeSantis et al. | 122/20 R |
| 8,094,998 | B2 * | 1/2012 | Rijskamp et al. | 392/451 |

* cited by examiner

*Primary Examiner* — Thor Campbell
(74) *Attorney, Agent, or Firm* — Sinorica, LLC

(57) ABSTRACT

This invention relates to an apparatus to efficiently and rapidly heat any liquid or fuel by providing large heat distribution. This apparatus has innumerable applications for efficiently heating water/fuel, using limited resources and providing cost-savings to private and commercial entities.

14 Claims, 1 Drawing Sheet

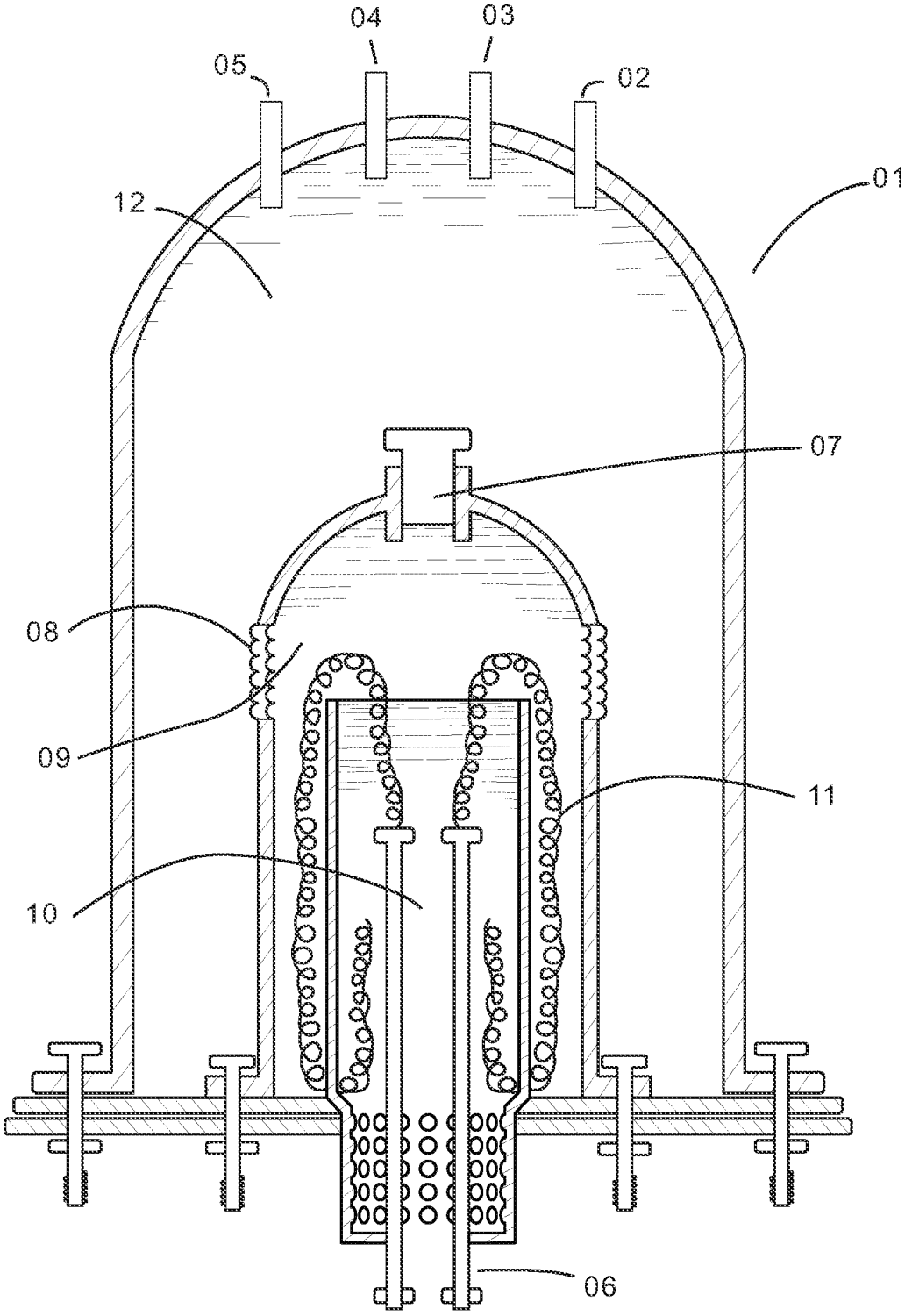
04
03
05
02
01
12
07
08
09
11
10
06

APPARATUS WITH EXPANSION CHAMBER PROVIDING LARGE HEAT DISTRIBUTION

The current application claims a priority to the U.S. Provisional application Ser. No. 61/145,450 filed on Jan. 16, 2009.

FIELD OF INVENTION

The present invention relates generally to advanced water heaters and methods of heating water for heating pool water, hotels, hospitals, car washes, or any other entity requiring hot water or heated fuel, and more particularly, using limited resources and providing cost-savings to private and commercial entities. This apparatus can supply not only heated liquids or fuel, but also can be used to provide an entity with steam, in lieu of a liquid form.

BACKGROUND OF THE INVENTION

When a water heater is used for heating pool water, hotels, hospitals, car washes, or any other entity requiring hot water or heated fuel, the water is typically heated from ambient temperature to a desired temperature of approximately 90 to 120 degrees Fahrenheit. Because heating pool water, hotels, hospitals, car washes, or other entities contain a large amount of water that must be heated rather rapidly, various types of water heaters have been used. Due to extensive building safety code regulations and high initial setup costs for gas water-heating, the majority of heating pool water, hotels, hospitals, car washes, or any other entity uses heaters that employ electric heat in some form or fashion.

Currently, water heaters or such apparatus are inefficient, creating waste and a high cost of energy to heat and maintain the hot water, liquid.

SUMMARY OF THE INVENTION

The present invention specifically addresses and alleviates the above mentioned deficiencies associated with the prior arts.

In this regard, the present invention comprises a new and improved heating element technology known as a novel expansion chamber providing large heat distribution to efficiently and rapidly heat any liquid or fuel by providing large heat distribution. This apparatus has innumerable applications for efficiently heating water or fuel, using limited resources and providing cost-savings to private and commercial entities. This apparatus can supply not only heated liquids or fuel, but also can be used to provide an entity with steam, in lieu of a liquid form.

BRIEF DESCRIPTION OF THE DRAWINGS

FIG. 1 is a block diagram of the water heater apparatus of this invention.

DETAIL DESCRIPTIONS OF THE INVENTION

The following detailed description and accompanying drawings are provided for purposes of illustrating and describing presently preferred embodiments of the invention and are not intended to limit the scope of the invention in any way. It will be recognized that further embodiments of the invention may be used.

Referring now to the drawings wherein FIG. 1 is a diagram of an advanced apparatus of novel water heater showing the water heater 12. The advanced water heater 12 of this invention provides quick heating and over 75% improvement of efficiency comparing to current water heaters available in the market. It further provides superior electric energy saving against current water heaters available in the market.

The first component in the advanced water heater includes a heating coil 11, consisting of 100% Titanium with five ohms resistance. The coil/Titanium wire is coiled and wrapped around a ceramic container 10.

The ceramic container 10 containing a ceramic core is embedded on a stainless steel housing, 6"×6" diameter, wherein the capacity and diameter may change according to applications. The ceramic core 10 is embedded in a stainless steel housing and. insulated with ceramic material.

The second component is Titanium rods with 2" diameter 06 embedded within the certain core such as ceramic core and surrounded by dielectric oil 09 and the ceramic core 10 with Titanium wire set 06 connected to the heating coil 11 in cement or ceramic 10 to hold the rods.

The third component is an expansion chamber 08, consisting of a 0.020 inch stainless steel chamber. The expansion chamber is attached to a stainless steel flange, 0.125 of an inch thickness, wherein the thickness may change according to applications.

The Titanium coil (see FIG. 1) is in the expansion chamber 08 and submerged in dielectric oil 09. The expansion chamber is equipped with a seal oil inlet 07 to maintain the oil within the expansion chamber 08.

The expansion chamber 08 consists of thermal expansion barrow such that larger thermal conductive surface of the heating chamber will be available to transfer heat to water chamber 01 more quickly and efficiently without the need for any enlargement.

The fourth component is a water tank 01, located on the outside of the expansion chamber 08, consisting of 0.040 of an inch stainless steel wall, with a capacity of 36 gallons of water, wherein dimensions may change with applications.

This water tank is equipped with four stainless steel couplings as follows:

a. a water intake 05 to insert cold water for heating;
b. a safety pressure valve 04 to release pressure in the event the pressure rises above 75 psi inside the water tank;
c. a temperature gauge 03 to obtain temperature reading; and
d. a hot water release/outlet 02 for whatever relevant use or application.

By releasing pressure in the event the pressure rises above 75 psi inside the water tank, the risk of overheating is eliminated. The temperature gauge 03 further provides a manual or automated monitoring means for safety codes.

The advanced water heater system described provides a highly efficient, quicker heating, energy saving, convenient, dependable, and safe water heater the for heating pool water, hotels, hospitals, car washes, or any other entity requiring hot water or heated fuel.

Among the many advantages of the novel water heater are listed as:

1. Quicker water heating.
2. Superior energy saving.
3. High efficiency.
4. Scalable in different sizes for water load.
5. Better protection against pressure and leaks.
6. Greater lifetime and wear.
7. Easier to manufacture, store, and ship.
8. Convenient.
9. Easy to install and remove.
10. Easy to use.

11. Economical water heater.
12. Reliable and rigid.
13. Easy maintenance.
14. Outstanding resistance to stress and failure.
15. Excellent structural strength and integrity.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive; the scope of the invention being indicated by the claims, rather than the foregoing description, and all changes which come within the meaning and range of equivalency of the claims are therefore intended to be embraced therein.

The invention claimed is:

1. A water heater system comprising:

a heating coil, consisting of 100% Titanium with five ohms resistance, coiled and wrapped around a ceramic core;

a pair of Titanium rods of 2" diameter embedded within the ceramic core and surrounded by dielectric oil and the ceramic core with Titanium wire in cement or ceramic to hold the rods;

the ceramic core is embedded on a stainless steel housing and insulated with ceramic material.

2. The water heater system according to claim 1, further comprising an expansion chamber, consisting of a stainless steel chamber of 0.020 inch thickness, attached to a stainless steel flange with 0.125 inch of thickness.

3. The water heater system according to claim 2, further comprising a Titanium coil in the expansion chamber and submerged in the dielectric oil, wherein the expansion chamber is equipped with a seal to maintain the dielectric oil within the chamber.

4. The water heater system according to claim 3, further comprising a water tanker equipped with stainless steel couplings of a water intake to insert water for quick and efficient heating.

5. The water heater system according to claim 4, wherein the water tanker is further equipped with stainless steel couplings of a safety pressure valve to release pressure in the event the pressure rises above a predefined critical level.

6. The water heater system according to claim 5, wherein the water tanker is further equipped with stainless steel couplings of an outlet to obtain temperature readings.

7. The water heater system according to claim 6, wherein the water tanker is further equipped with stainless steel couplings of a hot water release/outlet.

8. A water heater system comprising:

an expansion chamber, consisting of a stainless steel chamber of 0.020 inch thickness, attached to a stainless steel flange with 0.125 inch of thickness, and a heating coil, consisting of 100% Titanium with five ohms resistance, coiled and wrapped around a ceramic core.

9. The water heater system according to claim 8, wherein the Titanium coil in the expansion chamber and submerged in the dielectric oil, and the expansion chamber is equipped with a seal to maintain the dielectric oil within the chamber.

10. The water heater system according to claim 9, wherein the ceramic core is embedded on a stainless steel housing and insulated with ceramic material.

11. The water heater system according to claim 10, further comprising a pair of Titanium rods of 2" diameter embedded within the ceramic core and surrounded by dielectric oil and the ceramic core with Titanium wire in cement or ceramic to hold the rods.

12. The water heater system according to claim 11, further comprising a water tank, wherein the water tank is equipped stainless steel couplings as follows:

a) a water intake to insert water for quick and efficient heating;

b) a safety pressure valve to release pressure in the event the pressure rises above a predefined critical level.

13. The water heater system according to claim 12, wherein the water tanker is further equipped with stainless steel couplings of an outlet to obtain temperature reading.

14. The water heater system according to claim 13, wherein the water tanker is further equipped with stainless steel couplings of a hot water release/outlet.

* * * * *